US007431396B1

(12) United States Patent
Dasso

(10) Patent No.: US 7,431,396 B1
(45) Date of Patent: Oct. 7, 2008

(54) PORTABLE ARMREST CUSHION

(76) Inventor: Kurtiss L. Dasso, 2827 27th St., Rock Island, IL (US) 61201

( * ) Notice: Subject to any disclaimer, the term of this patent is extended or adjusted under 35 U.S.C. 154(b) by 0 days.

(21) Appl. No.: 11/634,396

(22) Filed: Dec. 5, 2006

Related U.S. Application Data

(60) Provisional application No. 60/748,032, filed on Dec. 7, 2005.

(51) Int. Cl.
*A47C 31/11* (2006.01)

(52) U.S. Cl. ..... 297/227; 297/411.2; 297/411.23

(58) Field of Classification Search ..... 297/227, 297/411.23, 411.26, 411.46, 411.2, 411.21
See application file for complete search history.

(56) References Cited

U.S. PATENT DOCUMENTS

| | | | | | |
|---|---|---|---|---|---|
| 1,247,547 | A | * | 11/1917 | KoEune | 297/411.23 |
| 1,962,508 | A | * | 6/1934 | Winsor | 296/153 |
| 2,877,049 | A | * | 3/1959 | Lucas | 297/411.21 |
| 3,884,495 | A | * | 5/1975 | Petock | 280/87.041 |
| 4,588,224 | A | * | 5/1986 | Hill, Jr. | 297/4 |
| 5,332,288 | A | * | 7/1994 | Coates | 297/411.23 |
| 5,429,416 | A | * | 7/1995 | Lofy | 297/411.23 |
| 5,605,374 | A | | 2/1997 | Perry | |
| 5,692,711 | A | | 12/1997 | Tucker | |
| 5,700,053 | A | * | 12/1997 | Downing | 297/227 |
| 5,797,655 | A | * | 8/1998 | Miles | 297/411.23 |
| 5,829,079 | A | | 11/1998 | Castro | |
| 5,829,832 | A | * | 11/1998 | Molee et al. | 297/397 |
| 5,904,406 | A | * | 5/1999 | Stewart | 297/397 |
| 5,934,754 | A | * | 8/1999 | Raffa | 297/392 |
| 5,979,987 | A | | 11/1999 | Rich | |
| 6,578,914 | B2 | | 6/2003 | Artsvelyan | |
| 6,604,789 | B1 | * | 8/2003 | Downing | 297/227 |
| 6,817,066 | B1 | * | 11/2004 | Williams et al. | 280/33.992 |
| 6,827,405 | B1 | * | 12/2004 | Roberts | 297/411.23 |
| 6,840,566 | B2 | * | 1/2005 | Bruton | 297/227 X |
| 7,111,905 | B2 | * | 9/2006 | Finney | 297/411.2 |

* cited by examiner

*Primary Examiner*—Rodney B. White
(74) *Attorney, Agent, or Firm*—John E. Cepican

(57) ABSTRACT

A portable releasably attachable cushion that can be used with rigid seat armrests to provide extra cushion support for the user's arm. In one embodiment, the cushion may have an outer covering and an inner padded structure. The inner padded structure may be a gel like material. The outer covering may be made of either a leather material or a material that is bacterial resistant. As described the cushion may be entirely non-metallic and non-rigid to aid in storage and portability. The cushion provides for deformable guide means in order to securely engage the cushion of the invention to armrests of various shapes and sizes.

2 Claims, 4 Drawing Sheets

PORTABLE ARMREST CUSHION

CROSS-REFERENCE TO RELATED APPLICATIONS

This application is a continuation of co-pending commonly owned U.S. Provisional Application No. 60/748,032, filed Dec. 7, 2005, entitled Portable Armrest Cushion. Priority is claimed under 35 U.S.C. §119(e). The contents of the same are expressly incorporated herein by reference.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

AUTHORIZATION PURSUANT TO 37 C.F.R. §1.71(d)(e)

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

Field of the Invention

The present invention relates to a portable cushion for use with an armrest. More specifically, the portable cushion may be used by a passenger using an aircraft seat armrest.

BRIEF SUMMARY OF THE INVENTION

A portable releasably attachable cushion is provided that can be used with rigid seat armrests to provide extra cushion support for the user's arm. In one embodiment, the cushion may have an outer covering and an inner padded structure. The inner padded structure may be a gel like material. The outer covering may be made of either a leather material or a material that is bacterial resistant. As described the cushion may be entirely non-metallic and non-rigid to aid in storage and portability. The cushion provides for deformable guide means in order to securely engage the cushion of the invention to armrests of various shapes and sizes.

Other objects, advantages, and novel features of the present invention will become apparent from the following detailed description of the invention when considered in conjunction with the accompanying drawings.

DETAILED DESCRIPTION OF THE INVENTION

Figure 1:
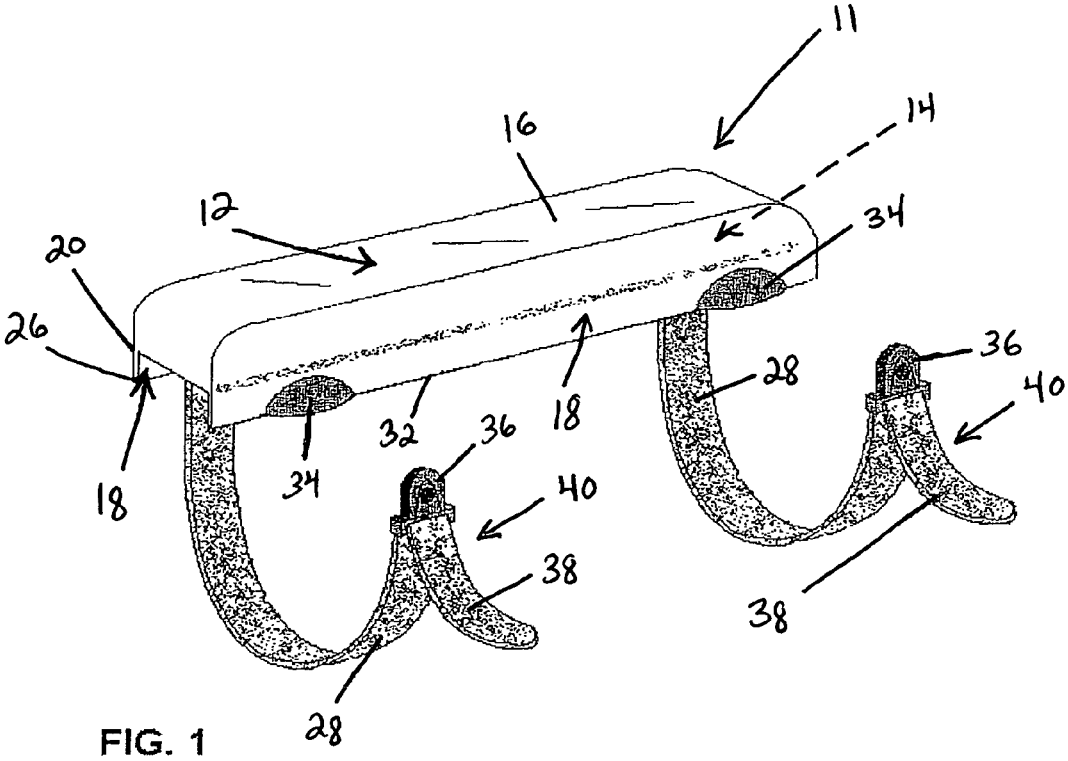
FIG. 1 is an outside perspective view of the portable armrest cushion described herein.

Referring now to the drawings, wherein like reference numerals designate identical or corresponding parts throughout the several views, FIG. 1 shows the portable armrest cushion of this invention generally at (11).

In overview, the present invention provides for a cushion (11) that can be used with a chair armrest, seat armrest, and other types of support structure (not shown). The armrest cushion (11) of the present invention is releasably attachable to the armrest or a support structure to provide a cushion support for the user of the armrest or the support structure.

The present invention provides an armrest cushion (11) that comprises an outer covering (12) and an inner gel cushion insert (14). The outer covering (12) may be made of soft fabric such as leather or micro-fiber that is sized to provide a tight fit over the inner cushion structure (14). Both the outer covering (12) and the inner gel cushion structure (14) are supportive and free of rigid components that would impede folding or portability. To further improve portability through travel security, the armrest cushion may also be composed of non-metallic elements.

FIG. 1 illustrates a top side perspective view of an armrest cushion (11) of the invention as it would be applied to an armrest, in a first embodiment. In FIG. 1 the armrest cushion (11) provides a relatively flat upper area (16) for engagement with the user's arm (not shown). Armrest cushion stabilizers (18) as found on the lower portion (20) of cushion outer covering (12) allow for slideable engagement with the upper side portions of said armrest. To inhibit lateral movement of the armrest cushion (11), a semi-adhesive non-skid pad (22) may be added to the lower inside portion (24) of the outer covering (12) surrounding said gel filled cushion insert (14). As described, the gel cushion insert (14) has a thickness of one inch, more or less, to minimize interference with the user and increase the user's enjoyment of the armrest cushion (11). As applied to aircraft armrests, the length of the armrest cushion (11) may be selected to equal or just slightly exceed the length of the interior armrest (not shown) to which the armrest cushion (11) is to be attached to facilitate use by users on each side of the armrest. In this application, the aisle side armrest cushions (11) could be selected to be shorter than the armrest cushions (11) for use with the interior armrest. The minimum profile of the armrest cushion (11) also avoids interference with the working functionality of an airline armrest and interference with the aisle passageway when used with an airline seat armrest.

As shown, the armrest cushion (11) has a first edge (26) which supports fixed attachment to said outer covering (12) of flexible pull strap(s) (28) having two ends (30, 40). The first end (30) of flexible pull strap (28) is fixed to the first edge (26) of said armrest cushion outer covering (12). The second edge (32) of the armrest cushion outer covering (12) supports a female clip receptor (34). A male quick connect clip (36) is attached to the second end (40) of the flexible pull strap (28). Interweaving flexible strap (28) around the armrest and engaging male quick connect clip (36) with female clip receptor (34), said female clip receptor (34) being intermeshed or integrated with second edge (32) of the outer covering (12) surrounding said gel filled cushion insert (14) to tensionably attach said armrest cushion (11) with the armrest. Application of increased force to the flexible pull strap tensioner (38) allows for increased tension between the armrest cushion (11) and the armrest to reduce movement and enhance stability.

Figure 2:
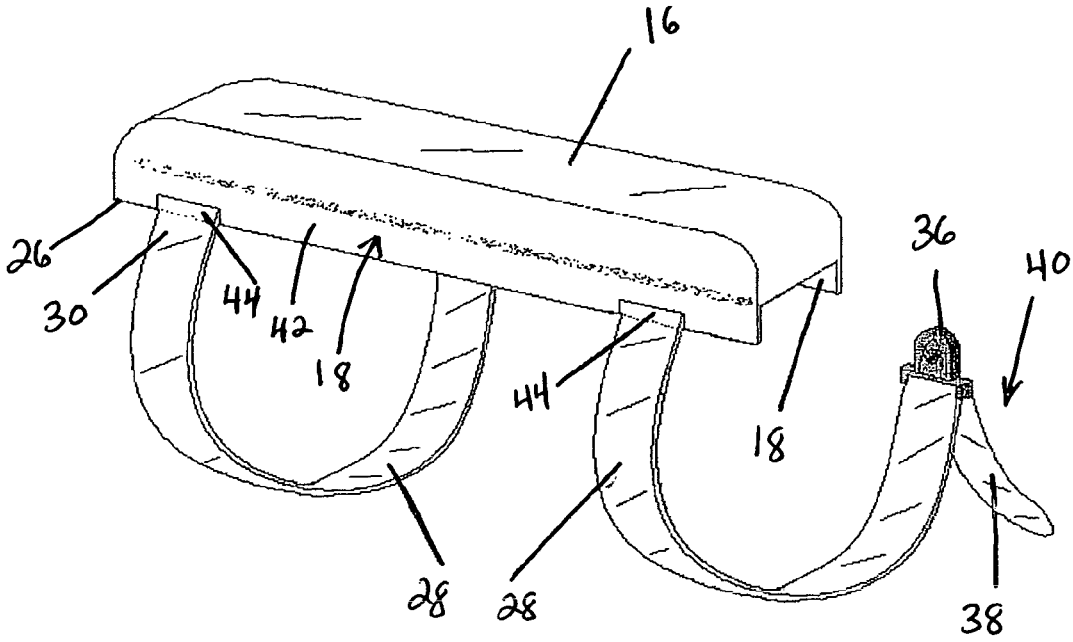
FIG. 2 is a perspective view of the opposite side of the portable armrest cushion described in FIG. 1.

FIG. 2 illustrates the opposite side perspective view of an armrest cushion (11) of the invention as it would be applied to an armrest, relative to FIG. 1. As shown in FIG. 2, the first end (30) of flexible pull strap (28) is fixed to the outer surface (42) of the first edge (26) of armrest cushion outer covering (12). The interface between the first end (30) of flexible pull strap (28) and the first edge (26) of the outer covering (12) are partially integrated to reduce the relative size of flexible pull strap seam (44).

Figure 3:
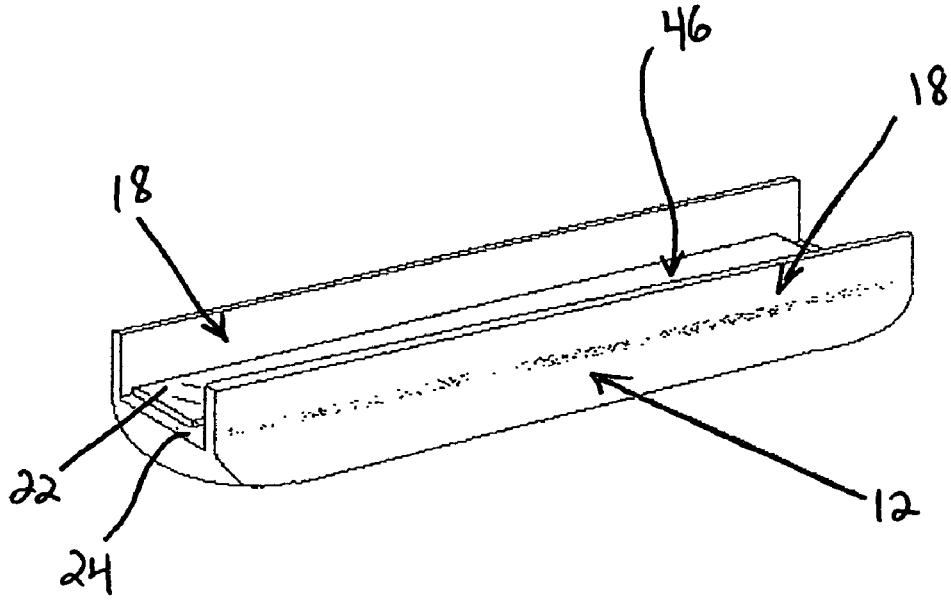
FIG. 3 is a detailed view of the bottom side of the cushion described in FIG. 1.
Figure 6:
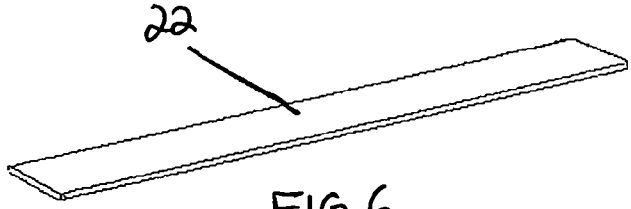
FIG. 6 is a perspective view of the adhesive non-skid pad of the portable armrest cushion.

As shown in FIG. 3, the covered armrest cushion (11) provides a relatively flat lower area (46) for engagement with the seat's armrest (not shown). Non-rigid cushion stabilizers (18) as found on the lower portion of armrest cushion (11) allow for slideable engagement with the upper side portions of said armrest. To inhibit lateral movement of the armrest cushion (11), a semi-adhesive non-skid pad (22) may be added to the lower inside portion (24) of the armrest cushion (11).

Figure 4:
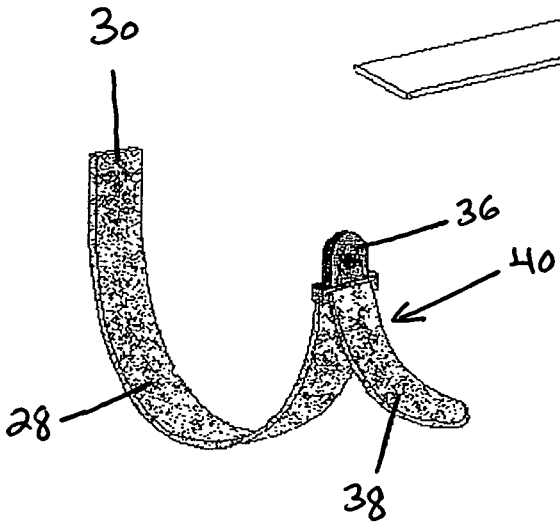
FIG. 4 is a perspective view of a flexible pull strap of the portable armrest cushion described herein.
Figure 5:
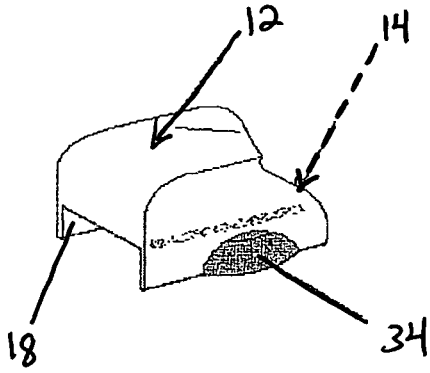
FIG. 5 is a fragmentary, perspective view showing the receptor of the portable armrest cushion.

FIG. 4 is a detailed view of other elements of the portable aircraft seat armrest cushion (11) described herein including cushion stabilizers (18) integrated into cushion outer covering (12) for engagement with the seat armrest. As described, the gel filled cushion insert (14) functions in combination with cushion outer covering (12) which may be selected from materials such as nylon, leather and/or micro-fiber. The cushion outer covering (12) may also be selected from materials having moisture resistance properties as well as anti-bacterial properties. As shown, female clip receptors (34) are integrated into the cushion outer covering (12) surrounding said gel filled cushion insert (14), for use with flexible pull strap (28). The flexible pull strap (28) may be made of any non-rigid, elastic material, including nylon, able to withstand the force necessary to engage the gel filled cushion insert (14) with the seat armrest. The opposite end (40) of the flexible strap (28) as shown has a male quick connect clip (36) for insertion within the female clip receptors (34). Due to security requirements and regulations at airports, it is preferred that embodiments for use with aircraft seat armrests have non-metallic connectors. It is also contemplated that the individual elements of the portable armrest cushion (11) will be flame retardant for use with commercial airplane seat armrests. To maintain the compact nature of the portable cushion (11) for travel applications, the distance between the male end (40) of the flexible pull strap (28) and the mating seam (44) will be minimized.

Additionally, it is within the scope of the present art for connectors (34) and (36) to be interchanged with hooks, loops and other arrangements allowing easy interconnection. As shown, the flexible pull strap has a tensioner (38). It is contemplated that any of several means may be used for strapping or attachment and provide a quick attach using male-female ends for a single pull strap with tensioner (38) to tighten and engage flexible strap (28) with armrest.

Finally, as shown in FIG. 4, it is contemplated that the lower inner portion (24) of gel cushion (14) may have an adhesive nonskid pad (22) placed thereon or therein. The pad (22) may run substantially the length of the cushion (14) to increase the engagement between the cushion (14) and the upper portion of the armrest surface. Any adhesive not leaving a residue and maintaining its tackiness may be chosen.

The industrial applicability of the portable armrest cushion (11) is believed to be apparent from the foregoing description. Although only exemplary embodiments of the invention have been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover both equivalent structures and structural equivalents of the structures described herein as performing the claimed function.

I claim:

1. A cushion, for use with a seat armrest, comprising:

a cushion insert;

an outer cover having spaced apart stabilizers, said cushion insert being disposed interior to said outer cover and said stabilizers;

a connector selectively extendable between said stabilizers;

said outer cover being selectively positionable upon a seat armrest, said stabilizers for engaging the seat armrest, said connector spanning said stabilizers, said cushion insert adapted to be disposed between the seat armrest and the arm of the user, said connector alternatively despanning said stabilizers thereby permitting removal of said cushion from the seat armrest;

further wherein a pull strap has a first free end and a second end fixed to one of said stabilizers, a receptor is fixed to another of said stabilizers, a clip is attached to said pull strap adjacent said first end, said clip removably insertable into said receptor.

2. The cushion of claim 1, wherein a tensioner is coupled to said clip, said pull strap being drawable through said tensioner.

* * * * *